US012221792B1

(12) United States Patent
Wheeler

(10) Patent No.: US 12,221,792 B1
(45) Date of Patent: Feb. 11, 2025

(54) RESILIENT CHANNEL COMPLEMENT THAT GIVES A SEAM OF DRYWALL PANELS IN CEILINGS A SHALLOW CATHEDRAL UPRISE

(71) Applicant: Markham Wheeler, Strafford, MO (US)

(72) Inventor: Markham Wheeler, Strafford, MO (US)

( * ) Notice: Subject to any disclaimer, the term of this patent is extended or adjusted under 35 U.S.C. 154(b) by 385 days.

(21) Appl. No.: 17/485,989

(22) Filed: Sep. 27, 2021

Related U.S. Application Data

(60) Provisional application No. 63/083,556, filed on Sep. 25, 2020.

(51) Int. Cl.
*E04F 13/08* (2006.01)

(52) U.S. Cl.
CPC ..... *E04F 13/0803* (2013.01)

(58) Field of Classification Search
CPC ... E04F 13/0803; E04F 13/0801; E04F 13/21; E04F 13/08; E04F 13/07; E04B 1/32; E04B 7/08; E04B 2001/3217; E04B 9/18; E04B 9/22; E04H 15/36
USPC .... 52/85, 86, 346, 56.04–56.6, 56.08, 56.09
See application file for complete search history.

(56) References Cited

U.S. PATENT DOCUMENTS 3,090,164 A * 5/1963 Nelsson ..... E04F 13/0803 52/347
3,177,620 A * 4/1965 Brown ..... E04B 2/7412 52/347
3,421,281 A * 1/1969 Harris ..... E04F 13/0803 52/506.05
3,477,187 A * 11/1969 Fruman ..... E04F 13/0803 D25/119
4,170,858 A * 10/1979 Walker ..... E04B 2/7409 52/480
4,227,360 A * 10/1980 Balinski ..... E04B 2/7409 52/243
4,750,307 A * 6/1988 Slager ..... E04B 2/7403 52/364
4,912,899 A * 4/1990 Plasker ..... E04B 9/008 52/417
7,191,570 B1 * 3/2007 Eaton ..... E04D 12/004 52/522
9,382,715 B2 * 7/2016 Cottier ..... E04F 13/0826
9,932,101 B2 4/2018 Giacalone et al. ..... B64C 1/00
10,151,117 B2 * 12/2018 Kuelker ..... E04F 13/0851
10,260,241 B2 * 4/2019 Kaligian ..... E04B 1/99
2003/0205016 A1 * 11/2003 Gulbrandsen ..... E04B 9/064 52/506.07

(Continued)

OTHER PUBLICATIONS https://www.tmsoundproofing.com/RC1-Resilient-Channels-32-Pack.html#:~:text=RC1%20One%20Leg%20Resilient%20Channels, 8.6'%20 (102%22) , Accessed Sep. 25, 2021.

*Primary Examiner* — Brian E Glessner
*Assistant Examiner* — Adam G Barlow
(74) *Attorney, Agent, or Firm* — Jonathan A. Bay

(57) ABSTRACT

In the broad class of building construction, the invention relates to single leg, resilient, sheet metal channels used as a decoupling means between steel or wooden framed ceilings to separate the building structure from drywall. This effectively reduces sound transmission through the floor and out of the ceiling. A single leg, resilient, sheet metal channel complement in accordance with the invention gives to a seam of drywall panels in ceilings the following: a shallow cathedral uprise.

17 Claims, 10 Drawing Sheets

(56) References Cited

U.S. PATENT DOCUMENTS

| | | | | |
|---|---|---|---|---|
| 2016/0244967 | A1* | 8/2016 | Zhou | E04F 13/14 |
| 2016/0244974 | A1* | 8/2016 | Cottier | E04F 15/102 |
| 2018/0010341 | A1* | 1/2018 | Krause | E04F 13/0817 |
| 2018/0171621 | A1* | 6/2018 | Kuelker | E04B 1/41 |
| 2019/0292774 | A1* | 9/2019 | Durali | E04B 1/34321 |

* cited by examiner

RESILIENT CHANNEL COMPLEMENT THAT GIVES A SEAM OF DRYWALL PANELS IN CEILINGS A SHALLOW CATHEDRAL UPRISE

CROSS-REFERENCE TO PROVISIONAL APPLICATION(S)

This application claims the benefit of U.S. Provisional Application No. 63/083,556, filed Sep. 25, 2020. The foregoing patent disclosure is incorporated herein by this reference thereto.

BACKGROUND AND SUMMARY OF THE INVENTION

In the broad class of building construction, the invention relates to single leg, resilient, sheet metal channels (see., eg., FIG. 10) used as a decoupling means between steel or wooden framed ceilings to separate the building structure from drywall—effectively reducing sound transmission—and; more particularly; to a single leg, resilient, sheet metal channel complement thereto that gives a seam of drywall panels in ceilings a shallow cathedral uprise.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 10:
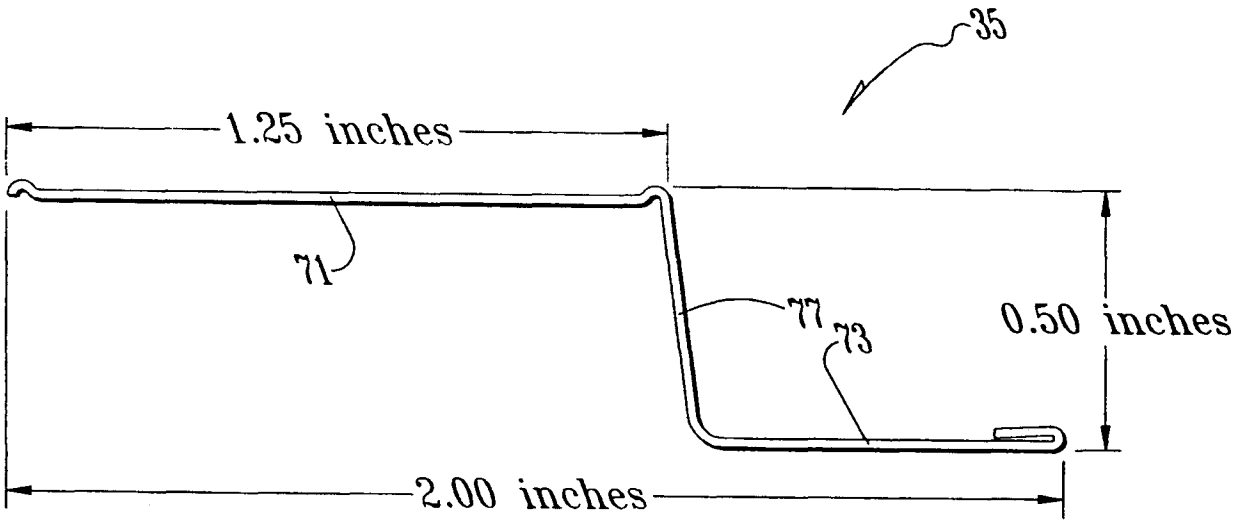
FIG.10 (Prior Art)
FIG. 10 is an elevational view comparable to FIGS. 3 and/or 3A except of a single leg, resilient, sheet metal channel in accordance with the prior art.

FIG. 10 shows a single leg, resilient, sheet metal channel 35 in accordance with the prior art, used as a decoupling means between steel or wooden framed ceilings to separate the building structure from the drywall, effectively reducing sound transmission.

Therefore, in effect, this a soundproofing measure. This particular product is referred to as RC-1 resilient channel 35 offered by the TRADEMARK SOUNDPROOFING® company of Suffern, New York. The information for FIG. 10 can be accessed online at:— https://www.tmsoundproofing.com/RC1-Resilient-Channels-32-Pack.html

#: ~:text=RC1%200ne %20Leg %20Resilient %20Channels,8.6' %20(102%22), accessed online on Sep. 25, 2020.

The following information is provided by the above web-page. The RC-1 resilient channel 35 is a thin, flexible metal channel that is screwed to ceiling joists. Drywall is then screwed to the RC-1 resilient channel 35, and the flexibility of the channel 35 creates a decoupled wall. The thickness is 25 Gauge (18 Mils). The width of the strip 71 for metal screws to fasten the RC-1 resilient channel 35 to the ceiling joists is 1.25 inches (~32 mm). The width of the strip 73 for metal screws to fasten a drywall panel to the RC-1 resilient channel 35 is less than three-fourths (¾ths) of an inch (less than ~19 mm). The overall width of the RC-1 resilient channel 35 is two inches (50.8 mm). The "single leg" 77 is the inclined wall sloping about 15° from vertical.

As an aside, the RC-1 resilient channel 35 is available in lengths of 8.5 feet (~2.6 m).

More pertinent here, the RC-1 resilient channel 35 provides a drop in elevation from a plane containing the bottoms of the floor joists to the top surface of the drywall panel by 0.5 inches (12.7 mm).

Figure 1:
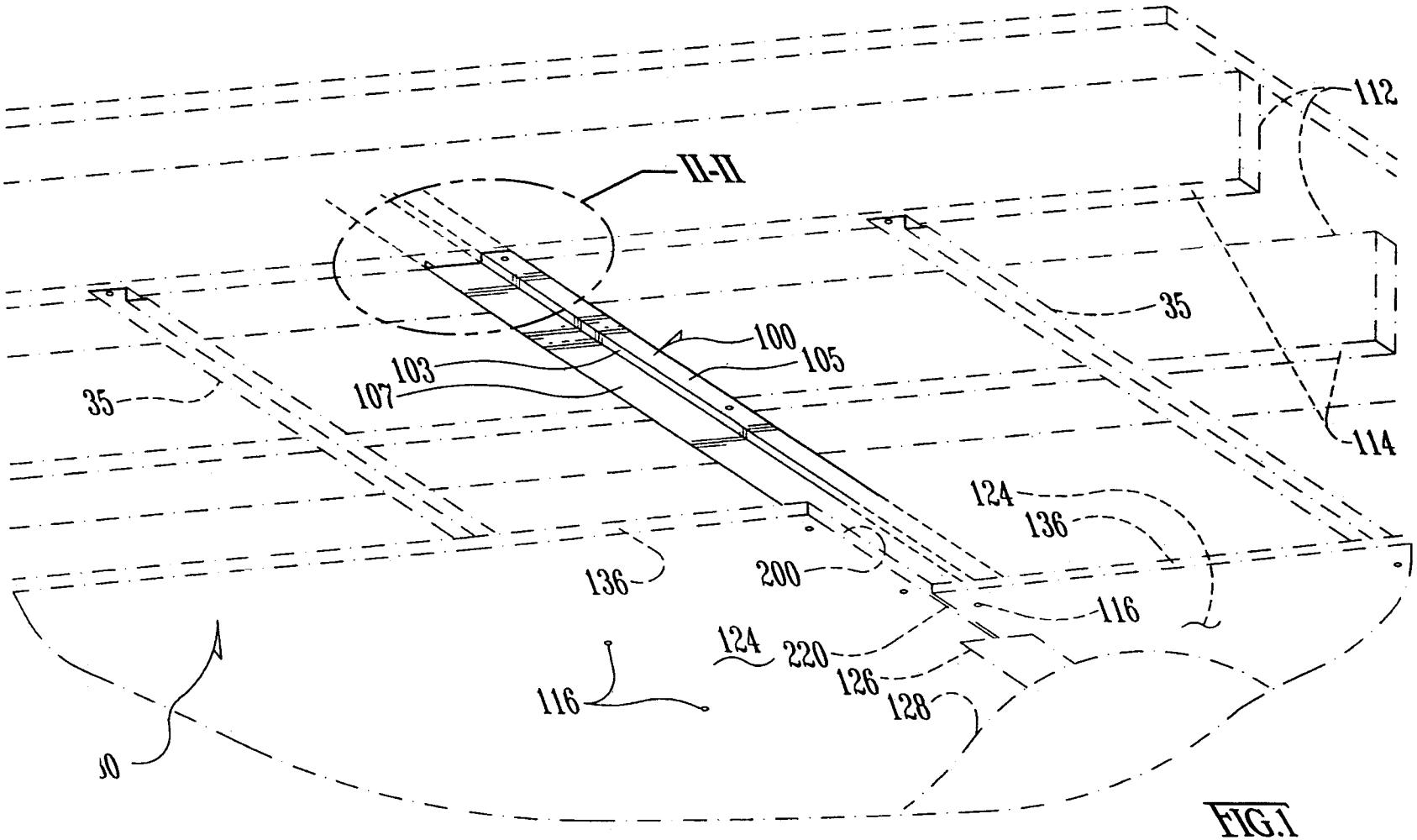
FIG. 1 is an upward-looking perspective view of a framed ceiling construction project in an intermediate stage of completion, showing a pair of single leg, resilient, sheet metal channels in accordance with the prior art (see, eg., FIG. 10) cooperatively flanking a resilient channel complement thereto in accordance with the invention (eg., FIGS. 2-9), that gives a seam of drywall panels a shallow cathedral uprise in this representative, non-limiting example of a ceiling.

FIG. 1 is an upward-looking perspective view of a framed ceiling 80 construction project in an intermediate stage of completion, showing a pair of single leg, resilient, sheet metal channels 35 in accordance with the prior art (see, eg., FIG. 10) cooperatively flanking a resilient channel complement 100 thereto in accordance with the invention (eg., FIGS. 2-9). In other words, the viewer is essentially standing on the floor and looking up.

In FIG. 1, for example and without limitation, the floor joists 112 are shown as boards of nominal 2×6 dimensional lumber (or alternatively, wooden framing joists). Such wooden framing joists 112 typically come in lengths of eight feet to sixteen feet. In use, such framing joists 112 are typically arranged in parallel courses with respect to each other, which courses are typically sixteen inches apart between centers. From the perspective of the relatively lower floor, these wooden framing joists 112 might be reckoned as 'ceiling' joists 112. Alternatively, from the perspective of the immediately succeeding floor, these wooden framing joists 112 might be reckoned as 'floor' joists 112.

To turn to matters with respect to drywall panels 124, the most commonly used panels 124 measure four feet wide but the lengths of choice are usually either eight feet long or twelve feet long. The preferred thickness of choice is usually one-half inch, but another widely available thickness is five-eighths of an inch. Other thicknesses are no doubt available, but usually, if a thickness of one-inch is desired, two half-inch panels 124 are layered together to build the combined thickness to one inch.

Thus a drywall ceiling panel 124 will have spaced long edges 136 four foot apart spacing spaced short edges 200 that might originally be eight feet or twelve feet apart. No doubt during construction, dimensions can be trimmed to fit the job.

To study FIG. 1 further, it shows three strips of single leg, resilient, sheet metal channels 35, 100 and 35 screwed to the bottoms 114 of the spaced framing joists 112. The channel 100 in the center comprises the single leg resilient sheet metal channel complement 100 in accordance with the invention. The two channels 35 flanking the resilient channel complement 100 in accordance with the invention comprise two single leg resilient sheet metal channels 35 in accordance with the prior art.

Given the foregoing, a typical drywall ceiling panel 124 will be hung by fasteners 116 (see, eg., FIGS. 8 and 9) from consecutive and spaced single leg resilient sheet metal channels 35 that are (for example and without limitation) sixteen inches apart between centers.

If a construction project is of any size, the drywall portions of the project will be handled by a drywall contractor forming a crew of several individuals. One or more of these individuals is likely to be a specialist among the crew for the application of tape 126 (see, eg., FIG. 9) and the 'floating' of drywall compound 128 (again, see FIG. 9). In some parts of the country, this party might be referred to as the 'taping and mudding' pro. As an aside, this specialist is also likely to be the "compound" expert among the crew in selecting the appropriate compound composition for the specific coats and finishes for the project. But that subject is a huge subject unto itself and is not particularly crucial here.

Figure 8:
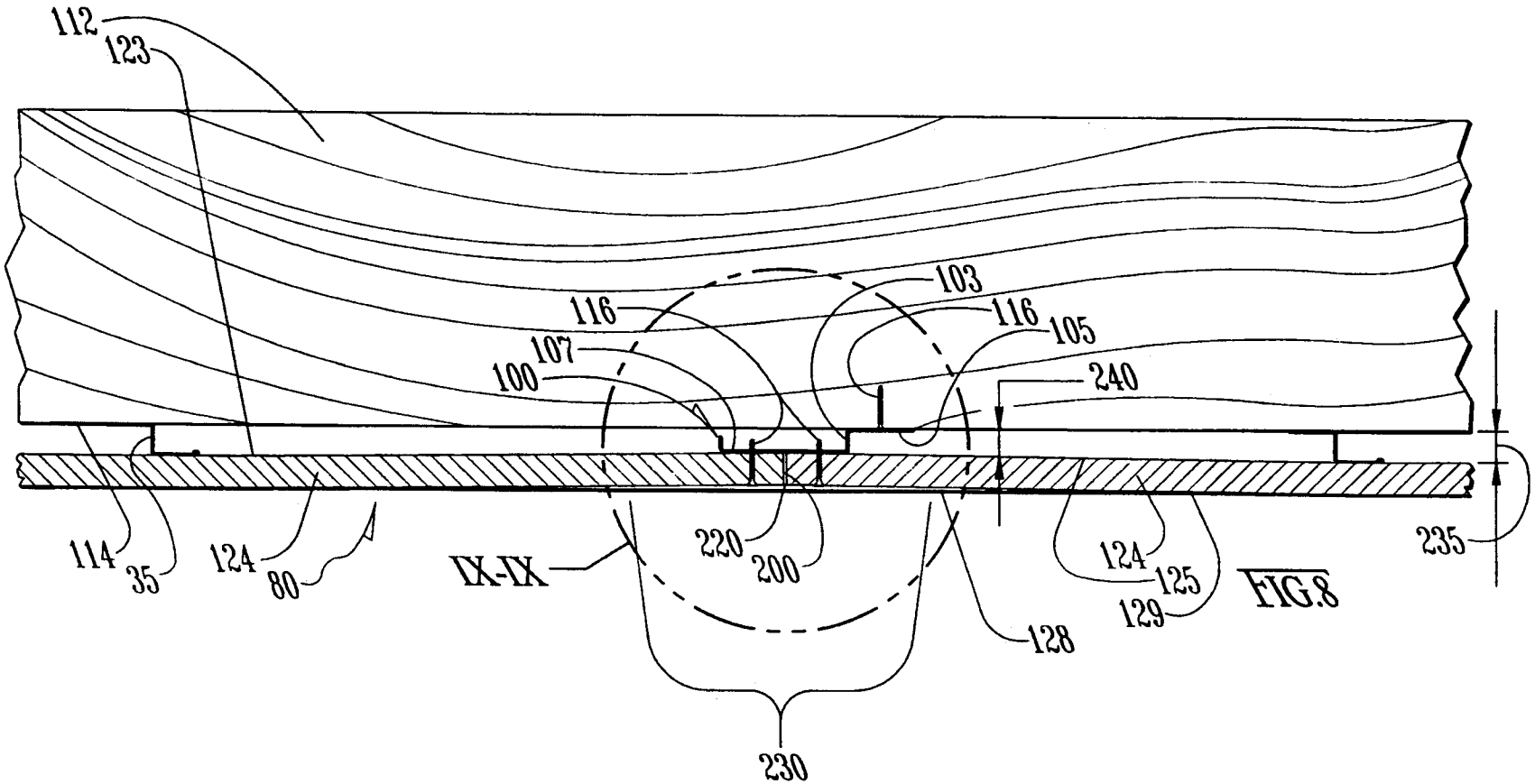
FIG. 8 is a reduced-scale elevational view, partly in section, that is taken in the direction of arrows VIII-VIII in FIG. 2.

It is an object of the invention that the single leg resilient sheet metal channel complement 100 in accordance with the invention essentially gives a seam 220 of drywall panels 124 in a ceiling 80 a shallow cathedral uprise 230 (see FIG. 8).

Figure 3:
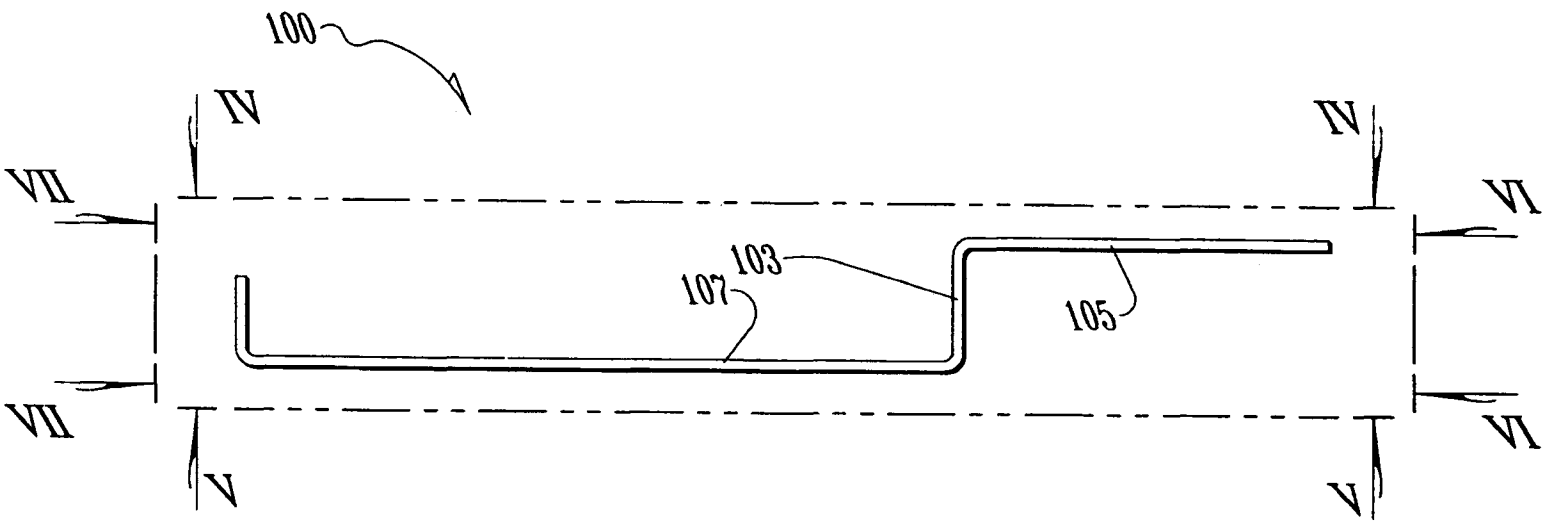
FIG. 3 is an enlarged-scale elevational view that is taken in the direction of arrows III-III in FIG. 2.
Figure 3A:
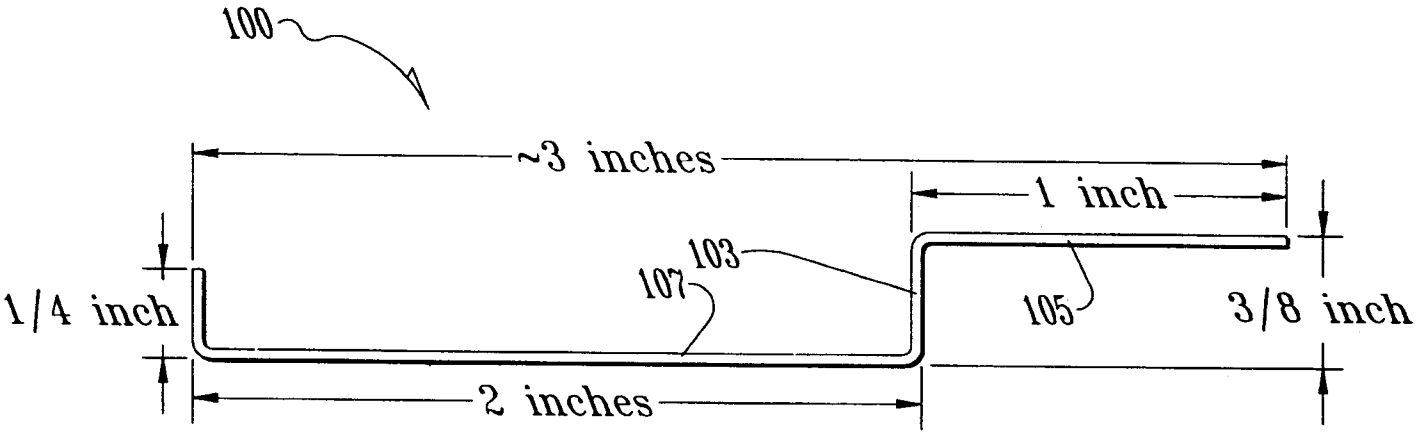
FIG. 3A is an elevational view comparable to FIG. 3 except providing inclusion of a non-limiting example of preferred dimensions.
Figure 4:
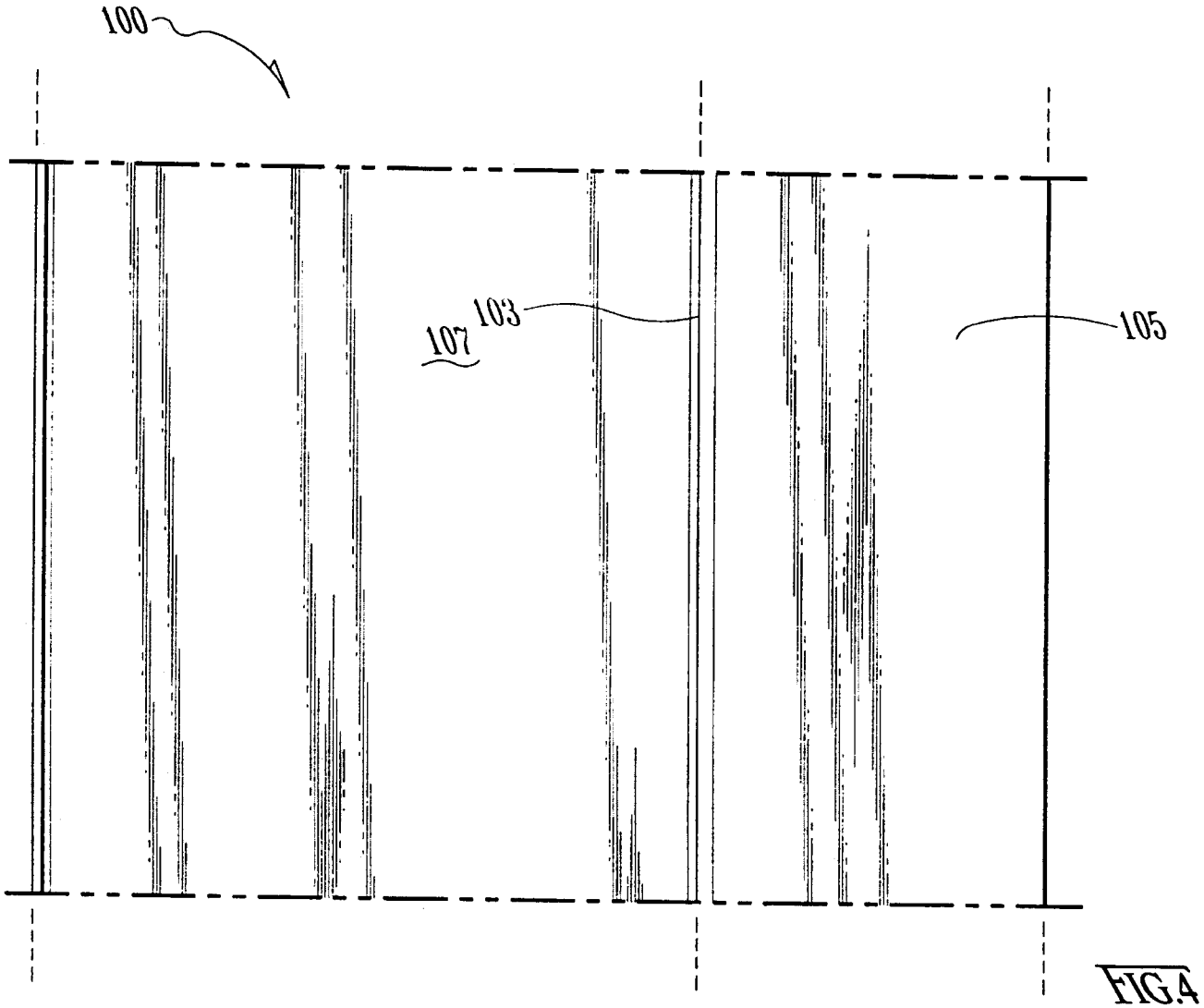
FIG. 4 is a top plan view that is taken in the direction of arrows IV-IV in FIG. 3.
Figure 5:
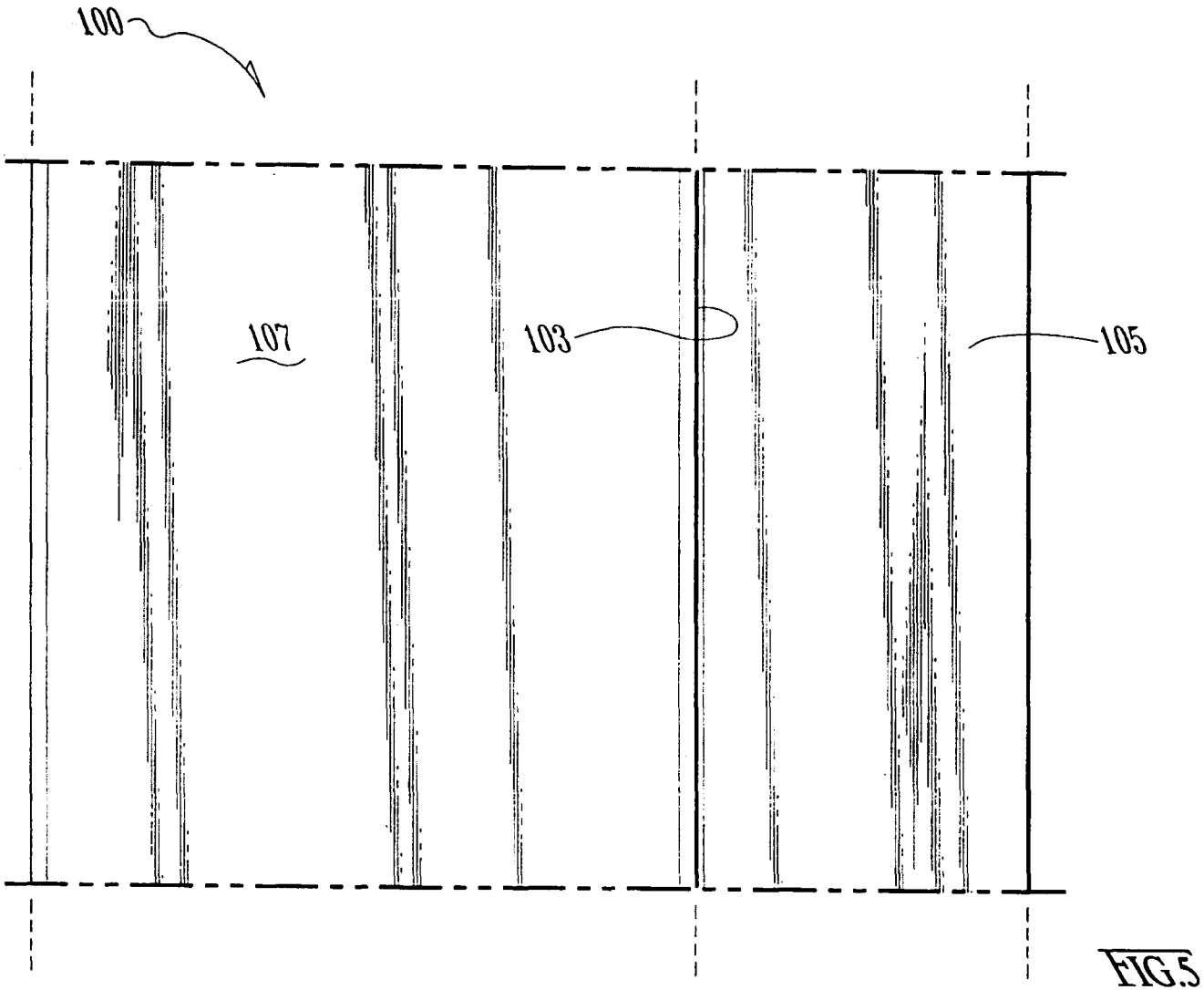
FIG. 5 is a bottom plan view that is taken in the direction of arrows V-V in FIG. 3.
Figure 6:
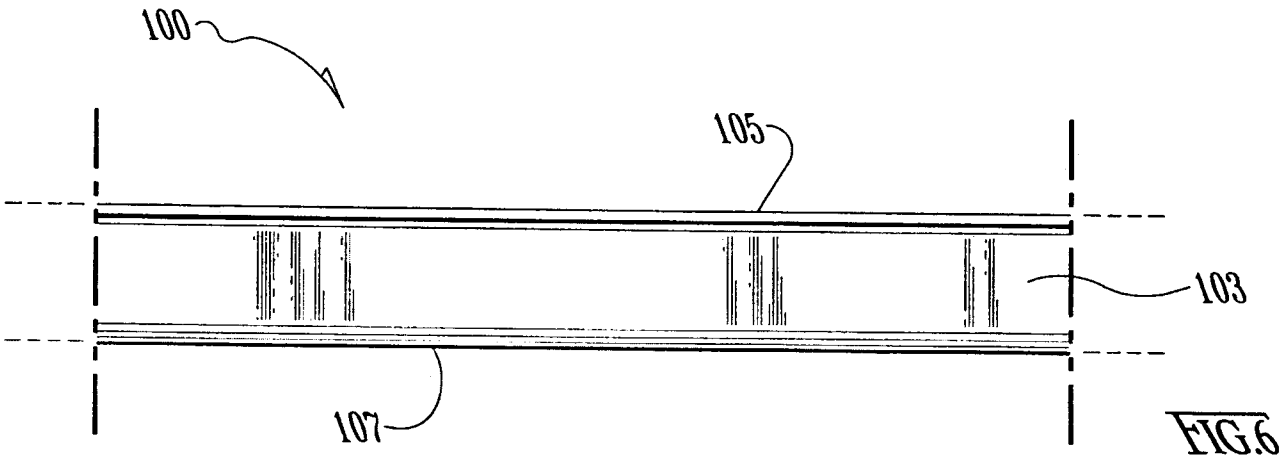
FIG. 6 is a front (albeit, the choice between front and rear direction is an arbitrary choice here) elevational view taken in the direction of the arrows VI-VI in FIG. 3.
Figure 7:
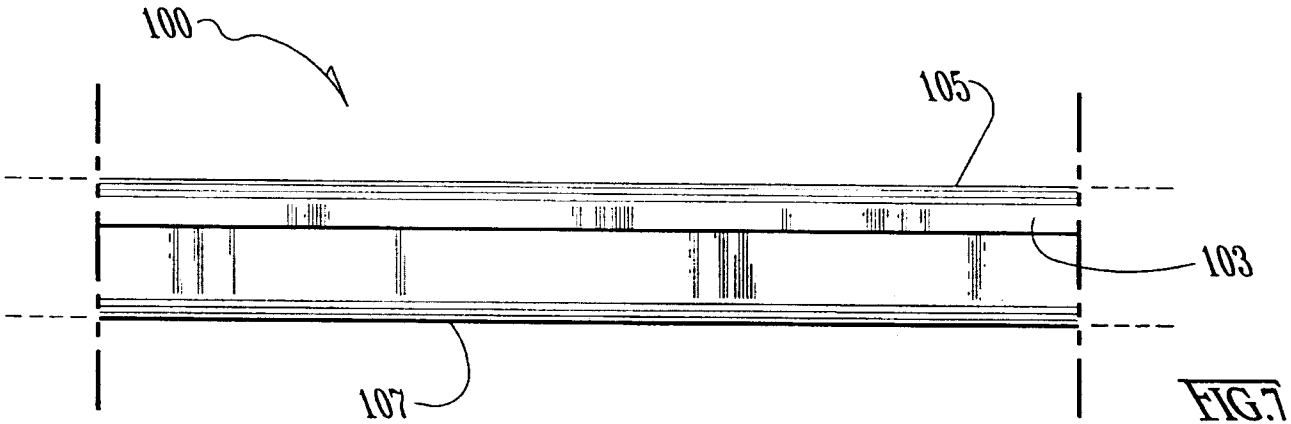
FIG. 7 is a rear elevational view that is taken in the direction of arrows VII-VII in FIG. 3.

To turn to FIG. 3A, it gives a non-limiting example of preferred dimensions for the single leg resilient sheet metal channel complement 100 in accordance with the invention. It comparably has a single leg 103, albeit more or less vertical, and is likewise produced of something like and without limitation 25 Gauge (18 Mils) flexible sheet metal, in varying lengths as needed.

Given the foregoing, a preferred width of the strip 105 for a line of metal screws 116 to fasten the single-legged resilient sheet metal channel complement 100 in accordance with the invention to the ceiling joists 112 is preferably one inch (25.4 mm). It is believed that any extra width is needless.

The preferred width of the strip 107 for the line metal screws 116 to fasten two drywall panels in 124 a butt-to-butt 200-to-200 seam 220 to the single leg resilient sheet metal channel complement 100 in accordance with the invention is two inches (50.8 mm). That way, there can be about one inch (25.4 mm) for overlapping the top surface of one of the drywall panels 124 at the seam edge 200 thereof. The leftover other one inch (25.4 mm) width is provided for overlapping the top surface of the other of the drywall panels 124 at its abutting, seam 220 forming edge 200.

In consequence, the strip 107 provides generous width for getting under the two drywall panels 124 at about inch-wide margins along their seam 220 forming edges 200. The foregoing makes the overall width of the single leg resilient sheet metal channel complement 100 in accordance with the invention to be about three inches more or less (~75 mm).

Much more pertinent here is, the relative drop 240 (see FIG. 8) in elevation of the single leg resilient sheet metal channel complement 100 in accordance with the invention as compared to the drop 235 (again, see FIG. 8) in elevation of the prior art (eg., RC-1) resilient channel 35.

Again, the drop 235 in elevation of the prior art (RC-1) resilient channel 35 from a plane containing the bottoms 114 of the floor joists 112 to the top surface 123 of the drywall panel 124 (and as shown by reconciling FIGS. 8 and 10 together) is given as 0.5 inches (12.7 mm).

In contrast, the drop 240 in elevation of the single leg resilient sheet metal channel complement 100 in accordance with the invention from a plane containing the bottoms 114 of the floor joists 112 to the top surfaces 123 of the two drywall panels 124 that are going to be joined in a permanent butt seam 220 (and as shown by reconciling FIGS. 3A and 8 together) is given as ⅜ths of an inch (~9.5 mm).

That means that the bottom surfaces 125 of the drywall panels 124 will be ⅛ths of an inch (~3.2 mm) higher under the single leg resilient sheet metal channel complement 100 in accordance with the invention than (as shown in FIG. 8) under the flanking prior art (RC-1) resilient channels 35.

Figure 9:
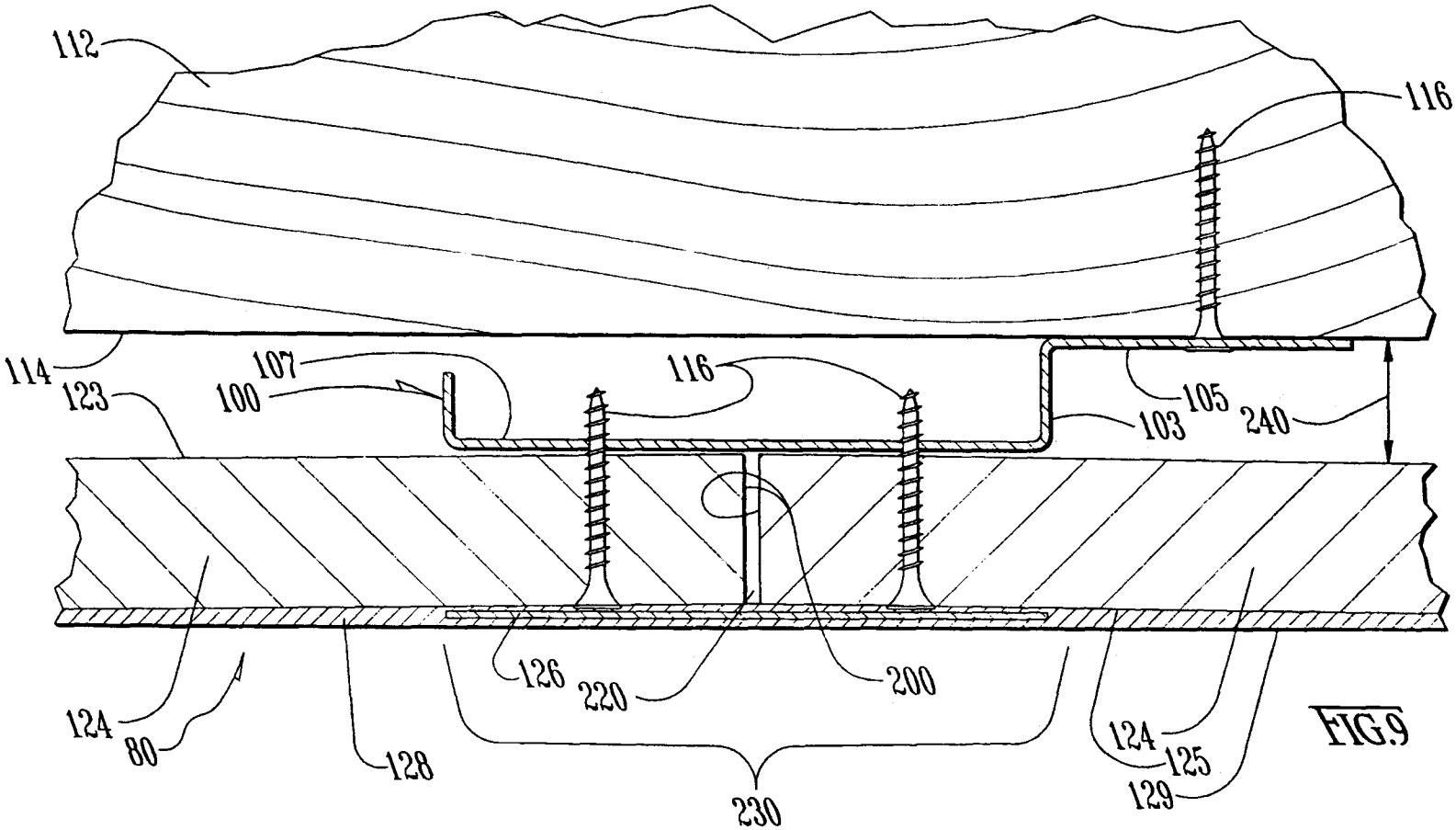
FIG. 9 is an enlarged-scale elevational view, partly in section, of the detail IX-IX in FIG. 8.

FIGS. 8 and 9 show the advantage of that. The very seam 220 between the two seam 220 forming edges 200 of the two abutting drywall panels 124 forms the shallow cathedral uprise 230.

A sheet rock worker who comes along and applies tape 126 to cover the seam 220, and then applies ("floats") drywall mud 128 to cover the tape 126 (ie., drywall finishing and/or joint compound), is provided with advantages in accordance with the invention. That is, the sheet rock worker has that shallow cathedral uprise 230 to advantageously work with, as more particularly explained below.

Without the shallow cathedral uprise 230, the bottom surfaces 125 of the two drywall panels 124 would be level and planar with one another. The sheet rock worker would have to feather the drywall mud 128 a good foot (~30 cm) on either side of the seam 220 or otherwise the drywall mud 128 would look like a keel or miniature rafter (eg., underhanging beam).

It is an aspect of the invention that the shallow cathedral uprise 230 allows the sheet rock worker to feather the drywall mud 128 such that the broad dried coat of the drywall mud 128 is level on the undersurface 129.

Figure 2:
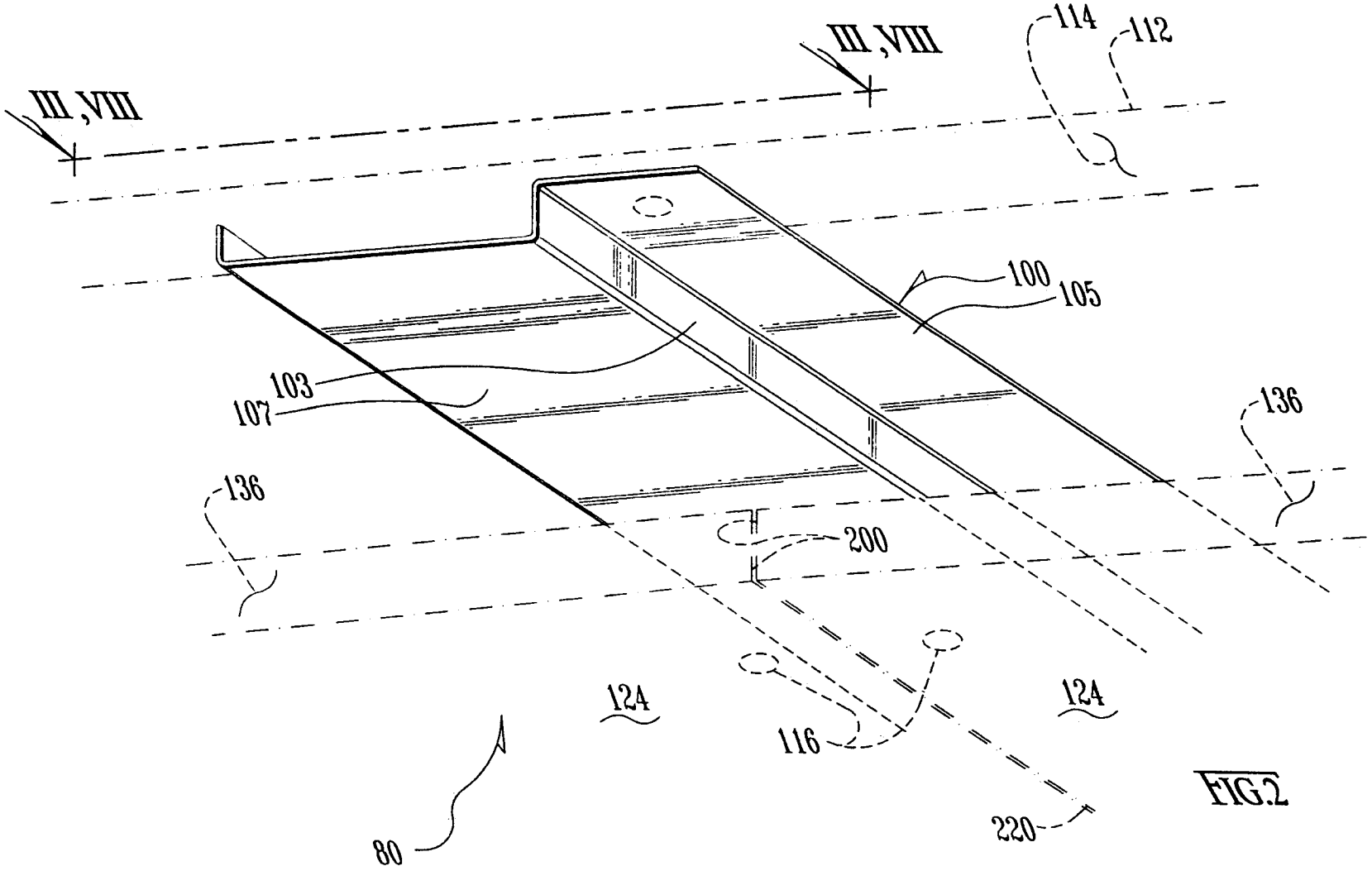
FIG. 2 is an enlarged-scale perspective view of detail II-II in FIG. 1.

FIG. 8 is a side elevation view of a framed ceiling 80 construction project in accordance with the invention, partly in section, and taken in the direction of arrows VIII-VIII in FIG. 2. FIG. 9 is an enlarged-scale side elevational view, partly in section, of the detail IX-IX in FIG. 8.

With general reference to FIGS. 8 and 9, they show the broad side of a framing joist 112, which for example and without limitation might be a nominal 2×6 board of wooden dimensional number. The length of the framing joist 112 is indefinitely long in these views, with the ends being outside of the view on both sides.

FIG. 8 shows the three strips of single leg, resilient, sheet metal channel 35, 100 and 35 in section. However, the channels 35, 100 and 35 are so thin in FIG. 8, it is impractical to include section shading.

The channel 100 in the center comprises the single leg resilient sheet metal channel complement 100 in accordance with the invention. The two channels 35 flanking the single leg resilient sheet metal channel complement 100 in accordance with the invention comprise two single leg resilient sheet metal channels 35 in accordance with the prior art.

Again, FIG. 8 shows a channel complement 100 in accordance with the invention flanked on the left and right by a pair of channels 35 in accordance with the prior art. As FIG. 1 shows, all the channels 35, 100 and 35 are aligned on parallel courses with each but which courses for the channels 35, 100 and 35 are at right angles to the parallel courses of the bottoms 114 of the framing joists 112.

Returning to FIG. 8, preferably the flanking prior art channels 35 are spaced away from the central inventive channel complement 100 by the same distance.

Relative to channel 35 of the prior art, the respective drop 235 in elevation from a plane containing the bottoms 114 of the floor joists 112 to the top surface 123 of the drywall panel 124 is a set distance. This can be denominated the "channel 35-induced drop in elevation" 235. The example given above comprises 0.5 inches (12.7 mm).

Relative to channel complement 100 in accordance with the invention, the respective drop 240 in elevation from a plane containing the bottoms 114 of the floor joists 112 to the top surfaces 123 of drywall panel 124 is another set distance, but a relatively lesser set distance. This can be denominated the "complement 100-induced drop in elevation" 240. The example given above comprises given as ⅜ths of an inch (~9.5 mm). Or that is, about 75% (seventy-five percent or three-fourths) of the channel 35-induced drop in elevation 235.

The result of all that is shown by general reference to FIGS. 8 and 9. The prior art channels 35 give the drywall panels the channel 35-induced drop in elevation 235 for the interior spans of the drywall panels 112 that are away from the edges 200. Conversely, the channel complement 100 gives the drywall panels 112 at their adjacent edges 200 the complement 100-induced drop in elevation 240 at the seam 220 between the adjacent drywall panels 112.

Hence the channel 35-induced drop in elevation 240 for the interior spans of the drywall panels 112 away from the edges 200 sets a "typical" plane for the height of the ceiling in the room. Conversely, the complement 100-induced drop in elevation 240 for the seam 220 between the adjacent drywall panels 112 warps the "typical" plane for the height of ceiling at the seam 220 between the drywall panels 112.

This "warp" in this description has been frequently been previously is referred in more descriptive terminology as the 'shallow cathedral uprise' 230. That is, the warp 230 is an uprise 230 from the elevation of the "typical" plane. The warp 230 has a linear aspect to it in that the warp 230 extends linearly (axially) along the seam 220. And, the warp 230 is also shallow. In the preferred embodiment, the warp/uprise 230 is only an ⅛th of an inch (~3.2 mm) deviation from the elevation of the typical plane, and that deviation is greatest in the crease of the uprise 230.

FIG. 9 shows advantages obtained thereby. The shallow cathedral uprise 230 accommodates seam-covering tape 126 as well as a coating or coatings of drywall compound 128 which does(do) not need to be feathered out as far from the seam 220 as without the shallow cathedral uprise 230. And when properly feathered out, the finish coating of the drywall compound 230 (if skillfully feathered out) should be planar with (or nearly so with) the typical plane of the ceiling 80 after completion.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A steel or wooden framed decoupled ceiling construction (80) for a steel or wooden framed ceiling construction project for a multi-story building structure, which decoupled ceiling construction (80) is characterized by:

a building structure comprising a multiplicity of longitudinally-spaced apart steel or wooden ceiling joists (112) typically arranged in parallel courses with respect to each other, which courses are typically evenly spaced apart between centers, and which ceiling joists (112) have bottoms (114);

a plurality of drywall panels (124) available in widths of a standard width wide between long edges (136), which are spaced apart by short edges (200) that are the standard width in length; and an unrelated multiplicity of single leg resilient sheet metal channels (35) of a set dimension used as a decoupling measure between the steel or wooden ceiling joists (112) to separate the building structure from the drywall panels (124), effectively serving as a soundproofing measure by reducing sound transmission;

said decoupled ceiling construction (80) comprising:

the plurality of drywall panels (124) having the long edges (136) spaced apart by the short edges (200);

the multiplicity of single leg resilient sheet metal channels (35) of the set dimension, each single leg resilient sheet metal channel (35) comprising an upper strip (71), a spaced away lower strip (73) and an interconnecting single leg (77);

an unrelated multiplicity of metal drywall screws (116);

wherein the upper strip (71) is fastened to the bottoms (114) of the ceiling joists (112) by spaced ones of the metal drywall screws (116);

wherein the plurality of drywall panels (124) are suspended by spaced ones of the single leg resilient sheet metal channels (35) by other spaced ones of the metal drywall screws (116) fastened into the lower strips (73) of the spaced ones of the single leg resilient sheet metal channels (35) such that the drywall panels (124) are arranged to produce an unrelated plurality of butt-to-butt seams (220), each seam (220) being composed of one short edge (200) of one drywall panel (124) on one side, and, another short edge (200) of another drywall panel (124) on the other side; and wherein the drywall panels (124) have bottom surfaces (125) that set a typical plane for the ceiling (80);

said decoupled ceiling construction (80) further comprising:

an unrelated plurality of single leg resilient sheet metal channel-complements (100);

wherein each single leg resilient sheet metal channel-complement (100) comprises an upper strip (105), a spaced away lower strip (107) and an interconnecting single leg (103);

wherein the upper strip (105) is fastened to the bottoms (114) of the ceiling joists (112) by spaced ones of the metal drywall screws (116) and arranged such that about one half of the lower strip (107) overlaps the one short edge (200) of the one drywall panel (124) in a given butt-to-butt seam (220), and, the about other half of the lower strip (107) overlaps the other short edge (200) of the other drywall panel (124) in the given butt-to-butt seam (220);

wherein the one short edge (200) of the one drywall panel (124) in the given butt-to-butt seam (220) is fastened to the lower strip (107) by spaced ones of the metal drywall screws (116), and, the other short edge (200) of the other drywall panel (124) in the given butt-to-butt seam (220) is also fastened to the lower strip (107) by spaced ones of the metal drywall screws (116);

wherein the leg (77) of the single leg resilient sheet metal channels (35) is of a dimension to produce a channel (35)-induced drop in elevation from the bottoms (114) of the ceiling joists (112) to the drywall panels (124)'s top surfaces (123);

wherein the leg (103) of the single leg resilient sheet metal channel-complements (100) is of another dimension to produce a complement (100)-induced drop in elevation from the bottoms (114) of the ceiling joists (112) to the drywall panels (124)'s top surfaces (123); and wherein the complement (100)-induced drop in elevation is less than the channel (35)-induced drop in elevation by a measure that warps the butt-to-butt seams (220) in shallow cathedral uprises (230) that accommodate seam-covering tape (126) as well as a coating or coatings of drywall compound (128) which when feathered out to a finish coating, the drywall compound (128) should be planar with the typical plane of the ceiling (80) after completion.

2. The decoupled ceiling construction (80) of claim 1, wherein:

the shallow cathedral uprises (230) are linear and extends along the respective butt-to-butt seams (220).

3. The decoupled ceiling construction (80) of claim 1, wherein:

wherein the complement (100)-induced drop in elevation is less than the channel (35)-induced drop in elevation by a measure that is about an eighth of an inch (~0.125 in., 3.175 mm).

4. The decoupled ceiling construction (80) of claim 1, wherein:

the typical plane of the ceiling (80) is horizontal.

5. The decoupled ceiling construction (80) of claim 4, wherein:

the single legs (103 or 77) can be alternately arranged with respect to the respective strips therefor (105 and 107, or, 71 and 73) alternately transverse or angled.

6. A decoupled ceiling construction (80) for a framed ceiling construction project for a building structure, which decoupled ceiling construction (80) is characterized by:

a building structure comprising a multiplicity of longitudinally-spaced apart ceiling joists (112) arranged in parallel courses with respect to each other, many of which courses are evenly spaced apart between centers, and which ceiling joists (112) have bottoms (114);

a plurality of drywall panels (124) available in widths of a standard width wide between long edges (136), which are spaced apart by short edges (200) that are the standard width in length; and a multiplicity of single leg resilient sheet metal channels (35) of a set dimension used as a decoupling measure between the ceiling joists (112) to separate the building structure from the drywall panels (124), effectively serving as a soundproofing measure by reducing sound transmission;

said decoupled ceiling construction (80) comprising:

the plurality of drywall panels (124) having the long edges (136) spaced apart by the short edges (200);

the multiplicity of single leg resilient sheet metal channels (35) of the set dimension, each single leg resilient sheet metal channel (35) comprising an upper strip (71), a spaced away lower strip (73) and an interconnecting single leg (77);

a multiplicity of fasteners (116);

wherein the upper strip (71) is fastened to the bottoms (114) of the ceiling joists (112) by several fasteners (116);

wherein the plurality of drywall panels (124) are suspended by several of the single leg resilient sheet metal channels (35) by several fasteners (116) fastened into the lower strips (73) of the several of the single leg resilient sheet metal channels (35) such that the drywall panels (124) are arranged to produce a plurality of butt-to-butt seams (220), each seam (220) being composed of one short edge (200) of one drywall panel (124) on one side, and, another short edge (200) of another drywall panel (124) on the other side; and wherein the drywall panels (124) have bottom surfaces (125) that set a typical plane for the ceiling (80);

said decoupled ceiling construction (80) further comprising:

a plurality of single leg resilient sheet metal channel-complements (100);

wherein each single leg resilient sheet metal channel-complement (100) comprises an upper strip (105), a spaced away lower strip (107) and an interconnecting single leg (103);

wherein the upper strip (105) is fastened to the bottoms (114) of the ceiling joists (112) by several fasteners (116) and arranged such that about one half of the lower strip (107) overlaps the one short edge (200) of the one drywall panel (124) in a given butt-to-butt seam (220), and, the about other half of the lower strip (107) overlaps the other short edge (200) of the other drywall panel (124) in the given butt-to-butt seam (220);

wherein the one short edge (200) of the one drywall panel (124) in the given butt-to-butt seam (220) is fastened to the lower strip (107) by several fasteners (116), and, the other short edge (200) of the other drywall panel (124) in the given butt-to-butt seam (220) is also fastened to the lower strip (107) by several fasteners (116);

wherein the leg (77) of the single leg resilient sheet metal channels (35) is of a dimension to produce a channel (35)-induced drop in elevation from the bottoms (114) of the ceiling joists (112) to the drywall panels (124)'s top surfaces (123);

wherein the leg (103) of the single leg resilient sheet metal channel-complements (100) is of another dimension to produce a complement (100)-induced drop in elevation from the bottoms (114) of the ceiling joists (112) to the drywall panels (124)'s top surfaces (123); and wherein the complement (100)-induced drop in elevation is less than the channel (35)-induced drop in elevation by a measure that warps the butt-to-butt seams (220) in shallow cathedral uprises (230) that accommodate seam-covering tape (126) as well as a coating or coatings of drywall compound (128) which when feathered out to a finish coating, the drywall compound (128) should be planar with the typical plane of the ceiling (80) after completion.

7. The decoupled ceiling construction (80) of claim 6, wherein:

the shallow cathedral uprises (230) are linear and extends along the respective butt-to-butt seams (220).

8. The decoupled ceiling construction (80) of claim 6, wherein:

wherein the complement (100)-induced drop in elevation is less than the channel (35)-induced drop in elevation by a measure that is about an eighth of an inch (~0.125 in., 3.175 mm).

9. The decoupled ceiling construction (80) of claim 6, wherein:

the fasteners (116) comprise metal drywall screws (116).

10. The decoupled ceiling construction (80) of claim 6, wherein:

the typical plane of the ceiling (80) is horizontal.

11. The decoupled ceiling construction (80) of claim 10, wherein:

the single legs (103 or 77) can be alternately arranged with respect to the respective strips therefor (105 and 107, or, 71 and 73) alternately transverse or angled.

12. A decoupled ceiling construction (80) for a framed ceiling construction project for a building structure, which decoupled ceiling construction (80) is characterized by:

a building structure comprising a multiplicity of longitudinally-spaced apart ceiling joists (112), and which ceiling joists (112) have bottoms (114);

a plurality of drywall panels (124) having widths extending between long edges (136) and lengths extending between short edges (200); and a multiplicity of single leg resilient channels (35) of a set dimension used as a decoupling measure between the ceiling joists (112) to separate the building structure from the drywall panels (124), effectively serving as a soundproofing measure by reducing sound transmission;

said decoupled ceiling construction (80) comprising:

the plurality of drywall panels (124) having the long edges (136) spaced apart by the short edges (200);

the multiplicity of single leg resilient channels (35), each comprising an upper strip (71), a spaced away lower strip (73) and an interconnecting single leg (77);

a multiplicity of fasteners (116);

wherein the upper strip (71) is fastened to the bottoms (114) of the ceiling joists (112) by several fasteners (116);

wherein the plurality of drywall panels (124) are suspended by several of the single leg resilient channels (35) by several fasteners (116) fastened into the lower strips (73) of the several of the single leg resilient channels (35) such that the drywall panels (124) are arranged to produce a plurality of butt-to-butt seams (220), each seam (220) being composed of one short edge (200) of one drywall panel (124) on one side, and, another short edge (200) of another drywall panel (124) on the other side; and wherein the drywall panels (124) have bottom surfaces (125) that set a typical plane for the ceiling (80);

said decoupled ceiling construction (80) further comprising:

a plurality of single leg resilient channel-complements (100);

wherein each single leg resilient channel-complement (100) comprises an upper strip (105), a spaced away lower strip (107) and an interconnecting single leg (103);

wherein the upper strip (105) is fastened to the bottoms (114) of the ceiling joists (112) by several fasteners (116) and arranged such that about one half of the lower strip (107) overlaps the one short edge (200) of the one drywall panel (124) in a given butt-to-butt seam (220), and, the about other half of the lower strip (107) overlaps the other short edge (200) of the other drywall panel (124) in the given butt-to-butt seam (220);

wherein the one short edge (200) of the one drywall panel (124) in the given butt-to-butt seam (220) is fastened to the lower strip (107) by several fasteners (116), and, the other short edge (200) of the other drywall panel (124) in the given butt-to-butt seam (220) is also fastened to the lower strip (107) by several fasteners (116);

wherein the leg (77) of the single leg resilient channels (35) is of a dimension to produce a channel (35)-induced drop in elevation from the bottoms (114) of the ceiling joists (112) to the drywall panels (124)'s top surfaces (123);

wherein the leg (103) of the single leg resilient channel-complements (100) is of another dimension to produce a complement (100)-induced drop in elevation from the bottoms (114) of the ceiling joists (112) to the drywall panels (124)'s top surfaces (123); and wherein the complement (100)-induced drop in elevation is less than the channel (35)-induced drop in elevation by a measure that warps the butt-to-butt seams (220) in shallow cathedral uprises (230) that accommodate seam-covering tape (126) as well as a coating or coatings of drywall compound (128) which when feathered out to a finish coating, fills the shallow cathedral uprise (230) to blend in with the elevation of the typical plane of the ceiling (80) after completion.

13. The decoupled ceiling construction (80) of claim 12, wherein:

the shallow cathedral uprises (230) are linear and extends along the respective butt-to-butt seams (220).

14. The decoupled ceiling construction (80) of claim 12, wherein:

wherein the complement (100)-induced drop in elevation is less than the channel (35)-induced drop in elevation by a measure that is about an eighth of an inch (~0.125 in., 3.175 mm).

15. The decoupled ceiling construction (80) of claim 12, wherein:

the fasteners (116) comprise metal drywall screws (116).

16. The decoupled ceiling construction (80) of claim 12, wherein:

the typical plane of the ceiling (80) is horizontal.

17. The decoupled ceiling construction (80) of claim 16, wherein:

the single legs (103 or 77) can be alternately arranged with respect to the respective strips therefor (105 and 107, or, 71 and 73) alternately transverse or angled.

* * * * *